US005558211A

United States Patent [19]

Heydner et al.

[11] Patent Number: 5,558,211

[45] Date of Patent: Sep. 24, 1996

[54] PUSH-BUTTON ACTUATED SAFETY SWITCH

[75] Inventors: Konrad Heydner; Oswald Onderka, both of Altdorf, Germany

[73] Assignee: Ellenberger & Poensgen GmbH, Altdorf, Germany

[21] Appl. No.: 397,256

[22] Filed: Mar. 15, 1995

[30] Foreign Application Priority Data

Sep. 19, 1992 [DE] Germany ..... 9212645 U
Oct. 13, 1992 [DE] Germany ..... 9213787 U

[51] Int. Cl.[6] ..... H01H 21/00

[52] U.S. Cl. ..... 200/553; 200/552; 200/529; 200/558; 200/559; 200/333; 200/293

[58] Field of Search ..... 200/5 A, 553, 200/556, 557, 558, 559, 329, 339, 341, 520, 333, 552, 529, 293

[56] References Cited

U.S. PATENT DOCUMENTS

| | | | |
|---|---|---|---|
| 3,518,597 | 6/1970 | Platz et al. . | |
| 4,083,027 | 4/1978 | Dobrosielski et al. . | |
| 4,117,285 | 9/1978 | Harper . | |
| 4,166,935 | 9/1979 | Norby | 200/552 |
| 4,329,669 | 5/1982 | Krasser et al. . | |
| 4,654,488 | 3/1987 | Westfall | 200/582 |
| 4,943,694 | 7/1990 | Kroth . | |

FOREIGN PATENT DOCUMENTS

| | | |
|---|---|---|
| 2390824 | 5/1978 | France . |
| 2671907 | 7/1992 | France . |
| 2720724 | 11/1978 | Germany . |
| 2721162 | 11/1978 | Germany . |
| 745744 | 4/1956 | United Kingdom . |
| 1520451 | 8/1978 | United Kingdom . |

*Primary Examiner*—David J. Walczak
*Attorney, Agent, or Firm*—Spencer & Frank

[57] ABSTRACT

A protective switch having an actuation side. The protective switch includes a base having walls, a pivot shaft connected to the walls of the base, and a switching rocker pivotal on the pivot shaft to be pivotally seated on the base. The switching rocker includes two lever arms for switching the protective switch on and off. A housing is placed on the base and protectively surrounds the switching rocker. A housing cover is located on the actuation side of the protective switch and protectively covers the switching rocker. The housing cover includes an opening therethrough. A plurality of hinges are each disposed on a respective lever arm of the switching rocker. An actuation attachment extends through the opening of the housing cover and is modularly connected to the switching rocker by the hinges for pivoting the switching rocker. The actuation attachment is selected from a kit composed of at least one switch button longitudinally displaceable in the housing cover and pivotally connected with one of the lever arms, and a switch cap rotatably movable relative to the pivot shaft and rigidly connected with the two lever arms of the switching rocker. The at least one switch member and the switch cap are interchangeable.

22 Claims, 5 Drawing Sheets

PUSH-BUTTON ACTUATED SAFETY SWITCH

BACKGROUND OF THE INVENTION

The invention relates to a protective switch having an actuation side. The protective switch includes a base having walls, a pivot shaft connected to the walls of the base, and a switching rocker pivotal on the pivot shaft to be pivotally seated on the base. The switching rocker includes two lever arms for switching the protective switch on and off. A housing is placed on the base and protectively surrounds the switching rocker. A housing cover is located on the actuation side of the protective switch and protectively covers the switching rocker. The housing cover includes an opening therethrough. A plurality of hinges are each disposed on a respective lever arm of the switching rocker. An actuation attachment extends through the opening of the housing cover and is modularly connected to the switching rocker by the hinges for pivoting the switching rocker.

Such protective switches are known from U.S. Pat. No. 4,083,027 and from GB 745 744. The protective switches have a bimetal-controlled switching mechanism for switching the protective switch off in case of an excess current. The switching mechanism is hingedly connected with a switching rocker. It is embodied as a two-armed lever. Each one of the two lever arms is hingedly connected with a separate switch button. The switching mechanism can be controlled via the switching rocker by pressure actuation of the switch buttons. In this way the protective switch can be manually switched on or off as required.

For reasons of technical safety, however, it may be necessary to provide the switching rocker with only one switch button, so that the protective switch can only be switched on manually, but not switched off.

In case of a change in the order of a client it can also be necessary not to equip the switching rocker with two switch buttons and instead to be able to actuate it as a one-piece element directly for switching the protective switch on and off. Protective switches with such a switching rocker are known from DE 29 28 277 C2 (=U.S. Pat. No. 4,329,669) and from DE 27 21 162 C2. The bimetal-controlled protective switches known from these publications can be manually switched on and off by means of the one-piece switching rocker projecting out of the housing cover.

However, these known switches are disadvantageous in that, with a change in the order of the client regarding the design and actuation of the switching rocker, it may be necessary to replace the entire protective switch, because all known protective switches have either only a one-piece switching rocker or a switching rocker with two separate switch buttons. Accordingly, components of the protective switch are also replaced which actually could have remained, such as the entire switching mechanism. The replacement of the switching rocker is therefore very expensive.

SUMMARY OF THE INVENTION

Departing from these disadvantages, it is the object of the invention to design a protective switch of the initially mentioned type in such a way that it can be adapted in a simple manner to the various options for manual actuation of the switching rocker.

This object is attained by an actuation attachment selected from a kit comprising at least one switch button longitudinally displaceable in the housing cover and pivotally connected with one of the lever arms, and a switch cap rotatably movable relative to the pivot shaft and rigidly connected with the two lever arms of the switching rocker. The at least one switch member and the switch cap are interchangeable; In accordance with the attainment of this object, the entire switching rocker is constructed of several parts. The two-armed lever constituting the actual switching rocker is not directly actuated. It is completely covered by the switch housing and therefore protected against mechanical damage. A switch cap or a switch button is placed on this lever depending on the individual requirements. It is only necessary to adapt the housing cover alone by means of an appropriate housing opening to the shape of the outline of the respective attachment element to accommodate its switching movements. Thus, the number of components to be replaced in connection with the changed manual actuation of the switching rocker is greatly reduced. In this way various switching rocker attachments can be realized with one and the same protective switch construction. This saves material and is cost-effective.

It is conceivable that the housing cover is made of one piece with the remaining housing. In this case it is the housing which is replaced in the case where the switching rocker actuation must be changed.

The switch cap acts like a spatial extension of the switching rocker beyond the housing opening of the housing cover. This two-piece construction of the entire switching rocker operates mechanically the same as the conventional switching rocker made of one piece. By means of the switch cap the switching rocker can be operated the same as the one known from DE 29 28 277 C2 (=U.S. Pat. No. 4,329,669) and from DE 27 21 162 C2.

To prevent wrong movements in connection with the actuation of the switching rocker because of which the protective switch could be accidentally changed over, the switch cap can be replaced by a switch button if necessary. For certain safety applications it is advantageous to equip the switching rocker with only a single switch button. It is for example conceivable that the circuit should not be allowed to be interrupted by the manual operation of the protective switch. In this case the protective switch has only one switch button for turning it on manually.

Since with a changed design of the entire switching rocker only the mentioned components are replaced, the switching mechanism with its characteristic triggering time for interrupting a circuit is kept. In contrast to the conventional exchange of the entire protective switch, the bimetal, once adjusted, therefore does not need to be reset again after a replacement has been made. Because of this the entire effort for assembly and adjustment of the protective switch is reduced.

A construction of the switching rocker with an attachment element is suitable for single pole as well as multi-pole protective switches.

A housing opening embodied as an edge of a receiving well and projecting past the housing color permits a problem-free guidance of the switch button in its longitudinal direction. The switch button can therefore be designed in a simple manner as a pushbutton and can be actuated by an operator. An effective transfer of force to the associated lever arm of the switching rocker is possible by the linear displacement of the switching button. Complicated connections between the switch button and the switching rocker for the force transfer can therefore be avoided.

The mechanical coupling between the switch button and the switching rocker comprises a hinged connection. The hinged connection causes the force transfer between the two elements. At the same time the hinge acts as a protection against the loss of the switch button, so that the switching mechanism of the protective switch is constructed compactly and mechanically stable without considerable expenditures.

Because of the positioning of the axes of rotation, the switch button and the switching rocker are disposed in a space-saving manner. All axes of rotation of the switching mechanism are disposed parallel in respect to each other. Therefore the lever-like components have the same plane of motion as the switch button and the switching rocker. This assures a narrow construction of the protective switch.

The pivot point of the lever arm is identical with the switching rocker shaft. Therefore the hinge shaft of the switch button is not exactly displaced in the direction of its longitudinal axis, but on a circular path with a radius corresponding to the length of the lever arm. However, the deviation of this movement path from the exact longitudinal displacement has been reduced to a minimum by the disposition of the lever arm in its center position. This is a requirement for the space-saving construction of the switching mechanism and for the employment of the switch button as a pushbutton which is displaceable along its longitudinal axis.

The switched state of the protective switch is made easily visible. The easy visibility of the switch positions of the switch button can additionally be improved in that its surface is provided with a particularly conspicuous warning color.

An additional function of the housing cover includes limiting the pivotabilities of switching rocker. A limited pivotability of the switching rocker is useful to assure two defined switching positions of the switch button. The limited pivotability also prevents the damage or destruction of individual components of the switching mechanism because of an accidentally overly large pivoting in their plane of movement. Thus the housing cover has, besides its general protective function against exterior effects on the switching mechanism, also a protective function against the excessive application of forces on the switching mechanism by an operator.

The covering faces of the lever arms are restable against the inner surface of the housing cover; and For an effective limitation of the switching rocker's pivoting mobility, the covering faces of the lever arms are restable against the inner surface of the housing cover. The covering surface of a lever arm which rests with its entire surface on the housing cover in one switched position causes a good surface pressure of the housing cover on the switching rocker. A limit stop acting over a surface in this way protects the switching rocker against damage or destruction in case of an excessively large force being exerted on the switching rocker in the direction of the longitudinal axis of the switch button. The limited pivotability of the switching rocker also relieves the other pivotable elements of the switching mechanism of excessively large mechanical stresses.

The well includes a protrusion extending in an area of an inner end of the well. Since the switch button and the switching rocker are hingedly connected with each other, the protrusions in the well additionally provide that after the switched position of the switch button has been attained, the switching rocker cannot be pivoted further. Therefore the entire switching mechanism is protected against excessively large mechanical stresses by means of the protrusions. The protrusions furthermore limit the linear displacement of the switching button such that it always has a clear switched position.

The switch button is located in a movement plane of the switching rocker, and grips the lever arm with a forked arm. The forked arm seats flatly against the switching rocker flanks. This provides for good mobility between the switch button and the switching rocker.

The bearing ends of the forked arms are embodied as cylinder jacket segments having the hinge shaft as the cylinder axis and are guided on appropriately hollowed-out flank protrusions of the switching rocker such as in a respective bearing block. The two troughs acting as bearing blocks extend far enough in the direction of the actuation end of the switch button that in both switch positions they form lateral pivot stops for the two forked arms. This provides for good guidance of the switch button during its switching movement and to limit is pivotability.

The switch button can be selectively connected with one of the two lever arms of the switching rocker using a hinge shaft. By means of this the switch button can be used for manually switching on and off of the protective switch as required.

The symmetrical design of the switching rocker is a prerequisite for an also symmetrical design of the housing or the housing cover. Because of this, one and the same housing cover can be used for covering the switching rocker and guidance of the movement of the switch button independently of the selection of the lever arm associated with the switch button. Furthermore, the symmetrical design of the switching rocker allows in a simple manner the selective placement of one and the same switch button on one of the two lever arms of the switching rocker.

The switch cap is structurally designed in such a way that it can be connected with the switching rocker used for the switch button so that the switching rocker and the switch cap together act like a one-piece switching rocker. In this case all structural particulars of the switching rocker which are suitable for fixing the switch cap in place have been taken into consideration in the construction of the switch cap, so that the switch cap is fixed on the switching rocker in a mechanically stable manner.

The upper cap surface covers the lever arms. Thus, the switching rocker and also the interior of the protective switch are well protected against mechanical damage. The immovable fixation in place has been realized, for example, by locking the switching rocker on the switch cap and it assures the mutual action of the switching rocker and the switch cap as a one-piece component.

The two hinged shafts already provided for the pivotable seating of the switch button are used in a further function as bearing shafts for the switch cap. In this way the immovable seating of the switch cap is achieved without additional outlay of components.

The end of the switch cap located on the rocker side is structurally designed in such a way that the switching rocker serves as a fixing aid during the attachment process of the switch cap. In addition, the lateral protrusions, which are already effective in connection with the switch buttons, assist in the immovable seating of the switch cap.

The subject of the invention will be explained in detail by means of the exemplary embodiments represented in the drawings. Shown are in:

DETAILED DESCRIPTION OF THE INVENTION

Figure 1:
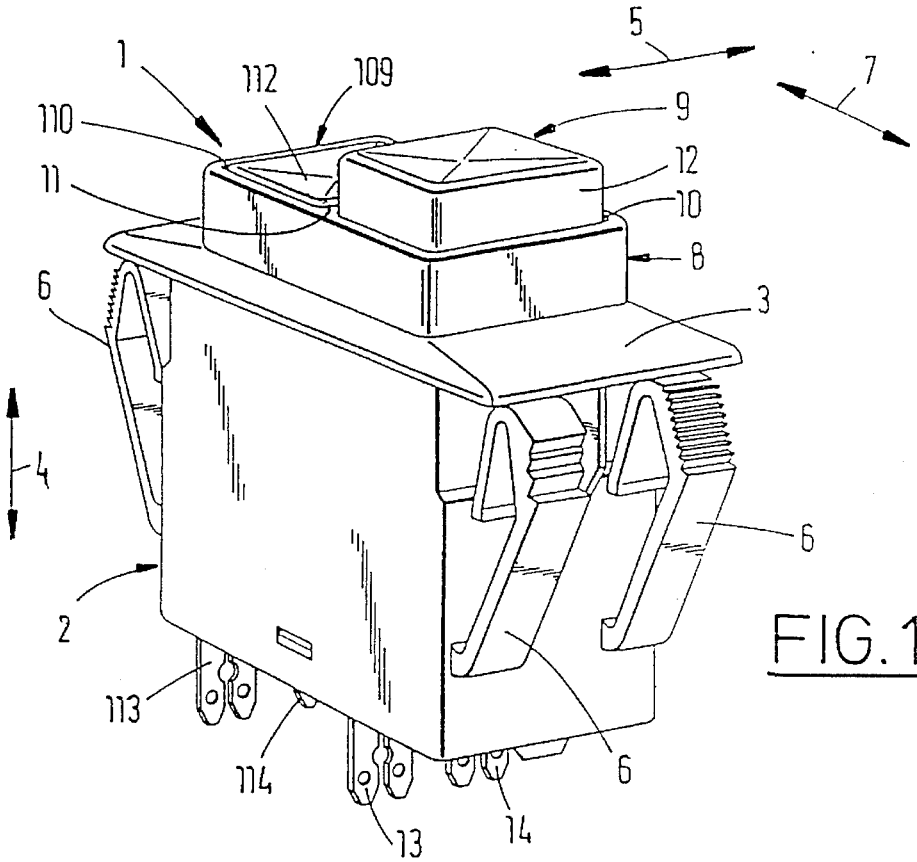
FIG. 1, a perspective representation of a protective switch with two pushbutton-like switch buttons, FIG. 2, the perspective view of a protective switch with one pushbutton-like switch button, FIG. 3, a sectional lateral view of the protective switch of FIG. 1 in its switched-on position, FIG. 4, a sectional lateral view of the protective switch of FIG. 2 in its switched-on position, FIG. 5, a partial view of the protective switch of FIG. 3 in its switched-off position, FIG. 6, a partial view of the protective switch of FIG. 4 in its switched-off position, FIG. 7, a view of the protective switch of FIG. 5, but with a switch cap instead of the switch buttons and with a housing cover adapted to the switch cap.
Figure 2:
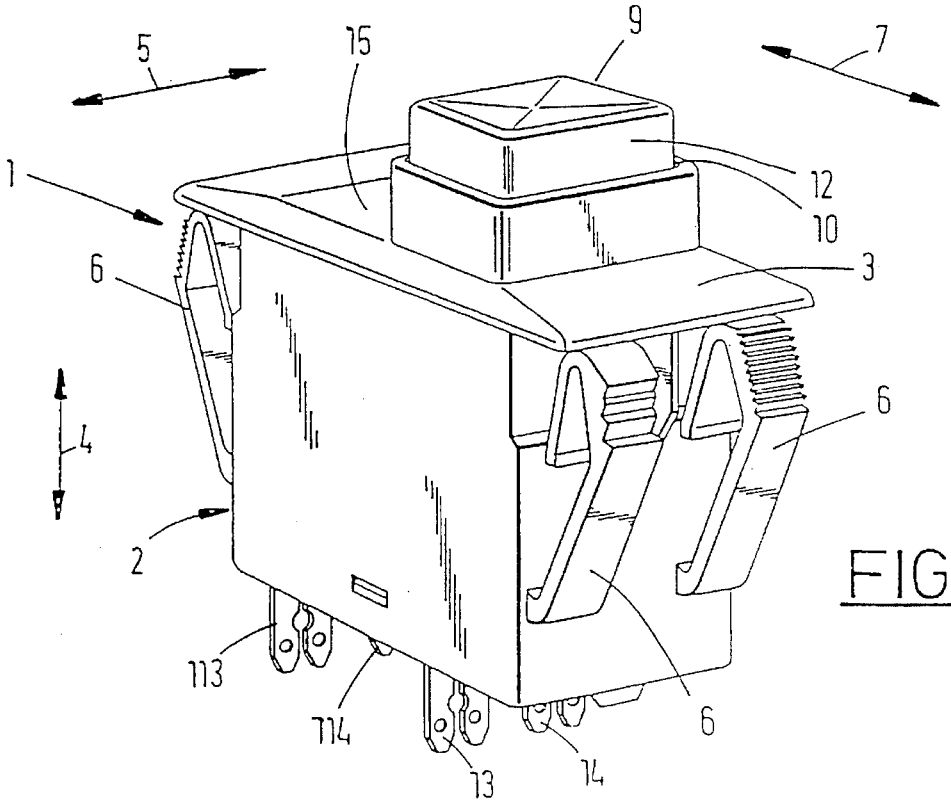

Referring to FIGS. 1 and 2, the protective switch 1 has a housing 2 with a housing cover 3 formed in one piece on it. The housing 2 is made of plastic. Viewed in an upward direction 4, the housing 2 has a rectangular outer contour. The narrow sides of the housing 2 extend in a transverse direction 5 oriented perpendicularly in respect to the upward direction 4. Respectively two resilient hooks 6, connected in one piece with the housing 2, for fastening the protective switch 1 on a face plate, not shown, are formed on the two lateral faces of the housing 2 enclosed in a plane formed by the upward direction 4 and the transverse direction 5.

Viewed in the upward direction 4, the housing cover 3 projects past the outer contour of the housing 2. In the upward direction 4 the housing cover 3 also has a rectangular outer contour and is enclosed in a plane formed by the transverse direction 5 and the upward direction 4. In this case the longitudinal direction 7 is arranged perpendicularly in respect to the upward direction 4 and perpendicularly to the transverse direction 5.

A well 8, its well height extending in the upward direction 4, for receiving two pushbutton-like actuable switch buttons 9, 109, is formed in one piece on the housing cover 3.

The well 8.is located in the central surface area of the housing cover 3. Viewed in the upward direction 4, it has a rectangular outer contour. It is in the shape of a parallelepiped, through which extend two interior well compartments 10, 110 in the upward direction 4. The interior well compartments 10, 110 also have a rectangular outer contour in the upward direction 4. Both interior well compartments 10, 110 have identical dimensions. The two interior well compartments 10, 110 are separated from each other by a separating web 11 extending in the transverse direction 5 and constituting a one-piece component of the well 8. The separating web 11 bisects the well 8 in the longitudinal direction 7.

The interior well compartments 10, 110 interlockingly enclose a respectively cuboid-shaped actuation end 12, 112 of the switch buttons 9, 109. The structural height (i.e., length in the upward direction) of the actuation ends 12, 112 in the upward direction 4 approximately agrees with the corresponding structural height of the interior well compartments 10, 110 (FIG. 3)(i.e., the height of the well and the length of the switch button are matched).

Figure 5:
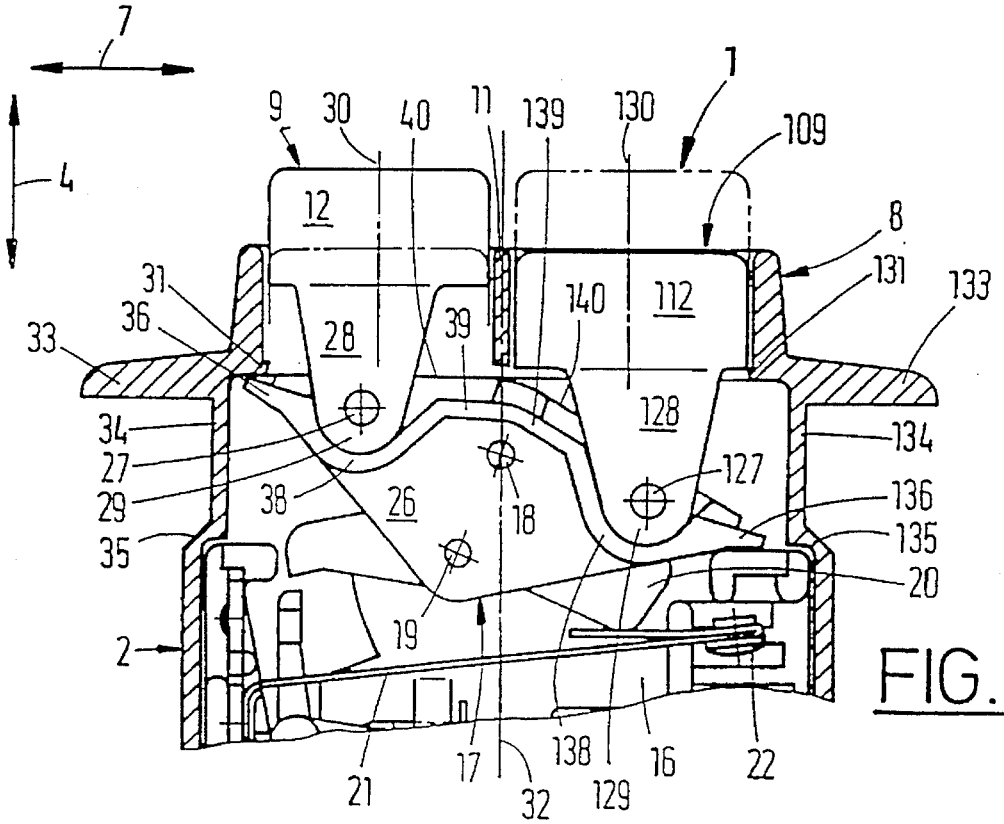

While the largest part of the structural height of the actuation end 12 of the switch button 9 projects outwardly out of the interior well compartment 10, the actuation end 112 of the switch button 109 is completely covered in the upward direction 4 by the well 8. The position of the switch button 9 indicates the switched-off position of the protective switch 1 (FIG. 5). The design of both switch buttons 9, 109 is identical. The surfaces of the two switch buttons 9, 109 can have different colors for a better recognition of the switched state of the protective switch 1.

Connecting terminals 13, 113 and 14, 114 for respectively one circuit can be seen in FIG. 1. Therefore the protective switch 1 is embodied here as a two-pole excess current protective switch. The connecting terminals 13, 113 and 14, 114 can be bridged by means of the switching mechanism disposed in the interior of the housing 2 (FIG. 3).

The protective switch 1 represented in FIG. 2 is constructed identically with the protective switch 1 shown in Fig. 1 with the exception of the well 8 and the housing cover 3. Only the interior well compartment 10 is provided in the well 8, so that it only receives the switch button 9. No opening for the interior well compartment 110 (FIG. 1) is provided on the housing cover 3 of FIG. 2 in the area of the well 8 of FIG. 1 receiving the switch button 109. The housing cover 3 is closed off at this place by a rectangular well closure 15 embodied to correspond to the cross section of the interior well compartment 110. It is a one-piece component of the housing cover 3.

Figure 4:
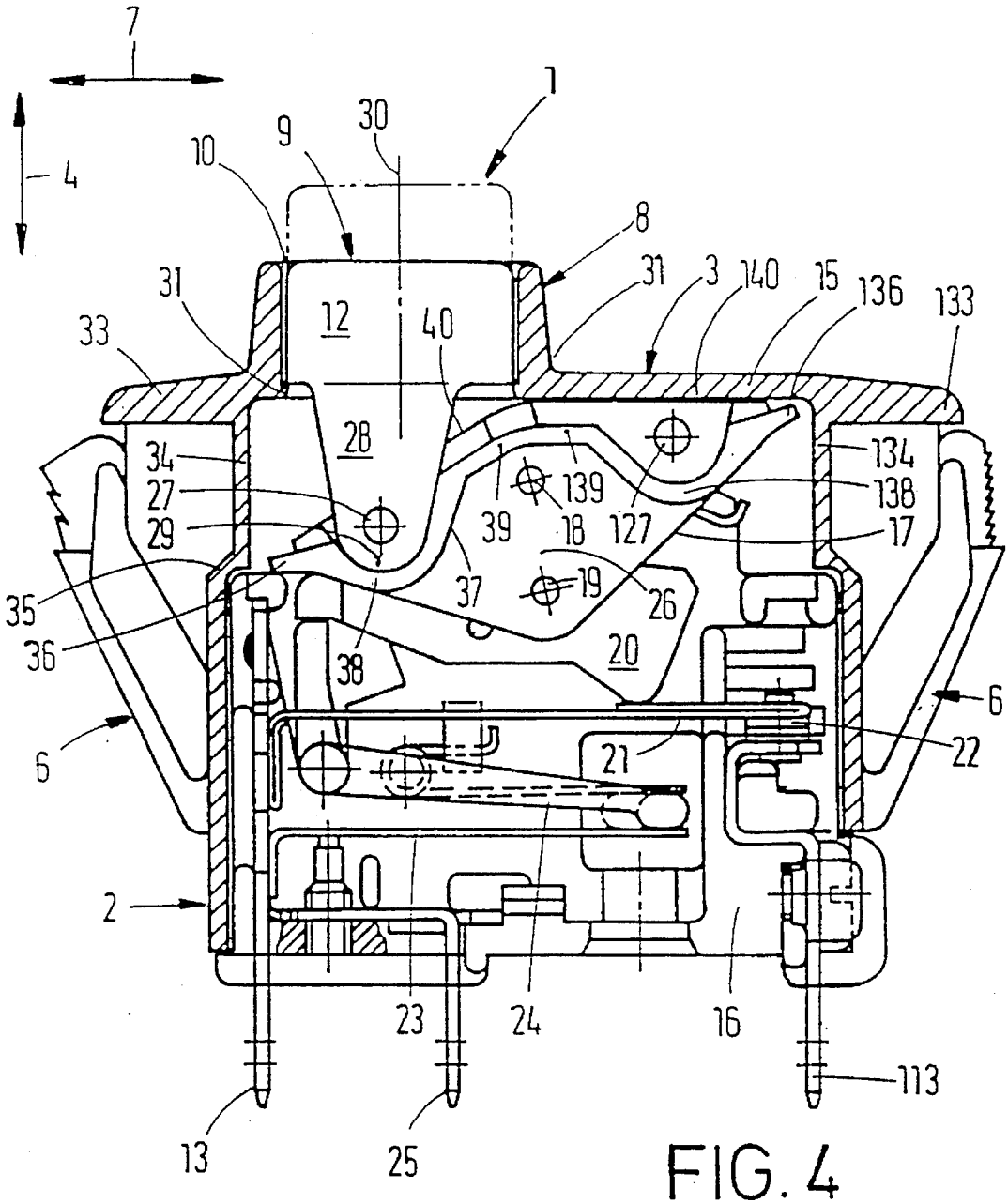

Since the protective switch 1 only has one switch button 9, it can only be switched on manually (FIG. 4, Dig. 6). In FIG. 2 and in FIG. 6 the protective switch 1 is in its switched-off position.

Figure 3:
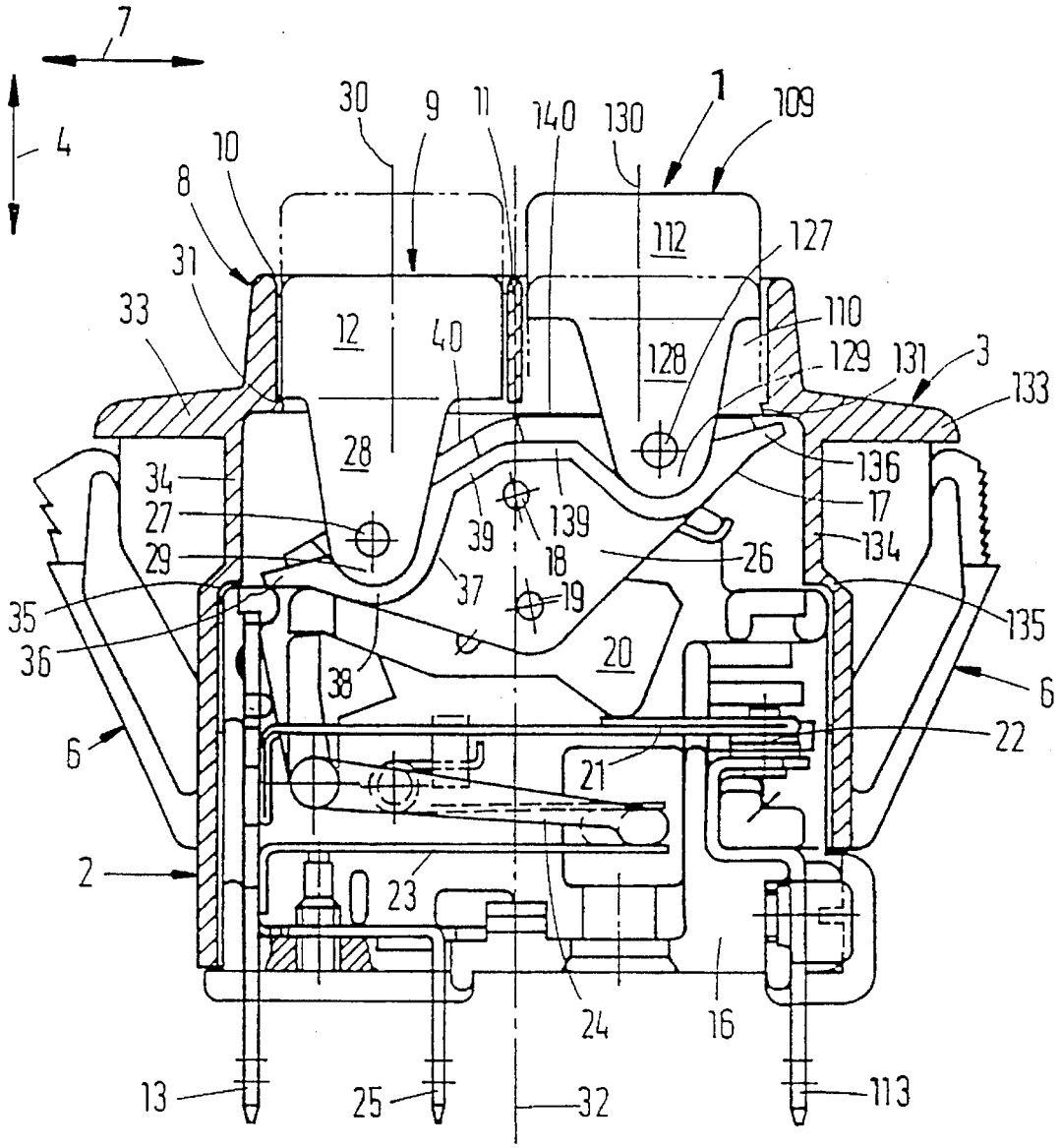

The switching mechanism arranged inside the housing 2 can be seen in FIG. 3. The individual components of the switching mechanism are supported or seated on a base 16. The design and mode of operation of the switching mechanism are extensively described in DE 27 21 162 C2 or DE 29 28 277.

A switching rocker 17 is rotatably seated on the base 16 by means of a switching rocker shaft 18. The switching rocker shaft 18 extends in the transverse direction 5. The plane of movement of the switching rocker 17 is constituted by the upward direction 4 and the longitudinal direction 7. The switching rocker 17 is the component of the known switching mechanism which is located closest to the well 8.

An actuating tongue 19 extending in the transverse direction 5 is disposed in the area of the switching rocker 17 facing the connecting terminals 13, 113. By means of the actuating tongue 19 the switching rocker 17 acts upon a latching lever 20 in the manner of a connecting link guide. The latching lever 20 acts with one lever end on a contact spring 21 disposed with its longer leg in the longitudinal direction 7. By means of a contact end 22 disposed on the free end of the contact spring 21, the latter is connected in an electrically conductive manner with the connecting terminal 113. Since the fastening end of the contact spring 21 is fixed on the connecting terminal 13, the two connecting terminals 13, 113 are also connected with each other in an electrically conductive manner. The protective switch 1 is therefore in the switched-on state.

Figure 6:
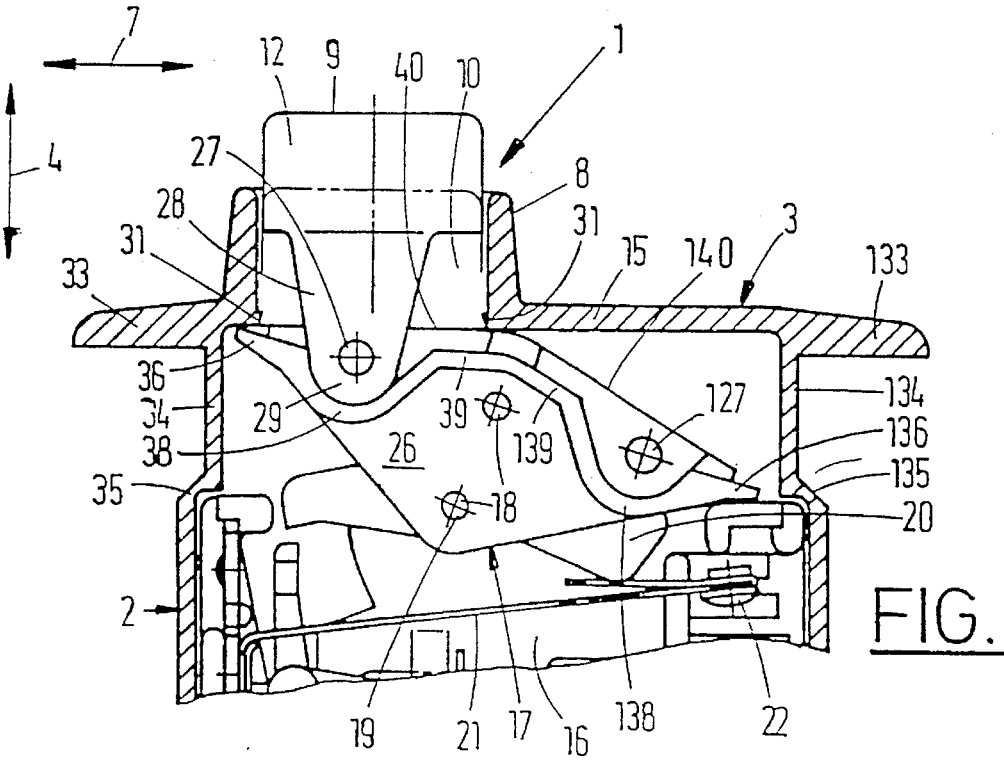

In case of excess current, a bimetal strip 23 extending with a movable leg in the longitudinal direction 7 acts on a lever arm of a trigger lever 24 also extending in the longitudinal direction 7. The trigger lever 24 is rotatably seated on a lever shaft extending in the transverse direction 5. The plane of movement of all levers in the switching mechanism is formed by the upward direction 4 and the longitudinal direction 7. In case of excess current, the bimetal strip 23 acts on the trigger lever 24 in such a way that the latter is turned in a counterclockwise direction in the upward direction 4. Because of the turning of the trigger lever 24 in the counterclockwise direction, the latching lever 20, which in the switched-on state of the protective switch 1 rests against the shorter lever arm of the trigger lever 24 and extends approximately in the upward direction 7, is unlatched by it. By means of this the switching rocker 17 is turned in a clockwise direction around its switching rocker shaft 18. Because of this the protective switch 1 is in the switched-off state (FIG. 5, FIG. 6).

A contact plug 25 is disposed in the area of the base 16 facing away from the switching rocker 17 in the upward direction 7. The contact plug 25, extending in the upward direction 4, projects out of the housing 2 in the same way as the connecting terminals 13, 113. The contact plug 25 is used for connecting a control device, not represented here, serving as a second protective element for a circuit. This is extensively described in DE 29 28 277 C1.

Viewed in the transverse direction 5, the switching rocker 17 has an approximately trapezoidal-shaped external contour. The trapezoidal-shaped lateral face of the switching rocker 17 forms an extension arm 26. Viewed in the transverse direction 5, a further extension arm 26 is disposed behind the base 16. The extension arms 26 are congruent. Viewed in the longitudinal direction 7, they form the U-leg of the U-shaped switching rocker 17. The extension arms 26 are enclosed in the plane constituted by the upward direction 4 and the longitudinal direction 7. The inner faces of the extension arms 26 which face each other in the transverse direction 5 respectively flank a lateral face of the base 16.

The trapezoidal-shaped exterior face of the switching rocker 17 contains an imagined shorter and longer diagonal line. The switching rocker shaft 18 extending in the transverse direction 5 is disposed in approximately the intersection point of these two diagonal lines. The two switch buttons 9, 109 are respectively seated pivotably movable on the switching rocker 17 via a hinge shaft 27 or 127. The hinge shafts 27, 127 and the switching rocker shaft 18 extend parallel to each other. The centers of the three above mentioned shafts are located on a common connecting line. This connecting line is approximately located on the longer of the imagined diagonal lines of the trapezoidal-shaped exterior face of the switching rocker 17. In its areas which are essential for receiving the switch button 9, 109 or the switch cap 41, the switching rocker is symmetrically constructed in relation to an imagined symmetry axis disposed perpendicular to this connecting line and bisecting the connecting line. For this reason both hinge shafts 27, 127 have the same distance from the switching rocker shaft 18.

The actuation end 12 of the switch button 9 is extended in the upward direction 4 in the direction toward the switching rocker 17 by a forked arm 28. A total of two forked arms 28 are formed as one piece with the actuation end 12. Viewed in the transverse direction 5, they are disposed congruently in respect to each other. The forked arms 28 have an exterior contour tapering in the direction of the hinge shaft 27. The forked arms 28 are rounded off approximately semicircularly in the area of an imagined cone tip. This area of the forked arms 28,128 forms one bearing end 29,129 of the switch button 9,109. In the longitudinal direction 7, the forked arms 28,128 have a shorter length than the actuation end 12.

The two forked arms 28 extend around the switching rocker 17 in the form of a fork and in the process flank the switching rocker on both sides parallel to its lever arm. The hinge shaft 27 extends through the two bearing ends 29 and the switching rocker 17. In this way the switch button 9 is seated pivotably and at the same time protected against loss on the switching rocker 17.

The forked arms 28 are symmetrically designed in relation to a symmetry axis extending parallel with the upward direction 4 and intersecting the hinge shaft 27. This imagined symmetry axis is disposed offset in the longitudinal direction 7 in respect to a longitudinal axis 30 of the switch button 9 also extending in the upward direction 4, wherein the distance of the imagined symmetry axis from the separating web 11 is greater than the distance of the longitudinal axis 30 from the separating web 11. The rectangular exterior contour of the actuation end is bisected by the longitudinal axis 30.

The above remarks in connection with the switch button 9 apply to the design of the switch button 109 and its disposition on the switching rocker 17 by means of the hinge shaft 127.

The transition areas between the lateral edges extending in the upward direction 4 and the longitudinal direction 7 of the actuation ends 12, 122 are rounded in the shape of a quarter circle. The transitions between the actuation end 12 and the forked arm 28 are also rounded. The analogous situation applies to the switch button 109.

Viewed in the longitudinal direction 7, the two hinged shafts 27, 127 have a larger distance from each other than the two longitudinal axes 30, 130.

The actuation end 12 is interlockingly placed in the interior well compartment 10. The actuation end 12 is completely covered in the upward direction 4 by the well 8 or the separating web 11. Viewed in the upward direction 4, the structural height of the interior well compartment 10 is slightly greater than the corresponding extension of the actuation end 12. The exterior face of the actuation end 12 facing away from the switching rocker 17, however, terminates flush with the well 8. For this purpose a nose-shaped end stop 31 is disposed on the interior end of the interior well compartment 10 facing the switching rocker 17. The end stop 31 is formed in one piece on the interior wall of the well 8 located opposite in the longitudinal direction 7 of the separating web 11. It projects slightly into the interior well compartment 10 and decreases its cross sectional surface. The longitudinal displacement of the switch button 9 along its longitudinal axis 30 in the direction toward the switching rocker 17 is limited in this way. The extension of the end stop 31 in the upward direction 4 corresponds to the difference between the height of the interior well compartment 10 and the structural height of the actuation end 12.

An end stop 131 for the switch button 109 is formed in the same way in the interior well compartment 110.

The housing cover 3 together with its well formed thereon is symmetrically constructed in respect to a switch axis 32 extending parallel with the upward direction 4 and intersecting the separating web 11. In FIG. 3, the housing cover 3 and the well 8 together have the approximate shape of a hat. Viewed in the longitudinal direction 7, in this case the end areas of the housing cover 3 constitute the brim of the hat projecting beyond the well 8. These brims act as cover ends 33, 133. Viewed in the longitudinal direction 7, the cover ends 33, 133 extend as far as the area of the hooks 6. The surface of the cover ends 33, 133 facing the hooks 6 extends exactly in the longitudinal direction 7. The surface facing away from this in the upward direction 4 is slightly inclined in respect to the longitudinal direction 7, so that the cover ends 33, 133 taper in the direction toward the hooks 6.

A lateral wall 34 of the housing 2, facing away from the well 8 and extending in the upward direction 4, adjoins the cover end 33. It is formed as one piece on the innermost, viewed in the longitudinal direction 7, area of the cover end 33. The lateral wall 34 is provided with a slope 35 at approximately the height of the hinge shaft 27. A further portion of the lateral wall 34 extending in the upward direction 4 adjoins the slope 35. The distance of this portion of the lateral wall 34 from the switch axis 32 is somewhat greater than the same distance of the portion of the lateral wall 34 immediately adjoining the cover end 33. In its area facing away from the well 8 in the upward direction 4, the interior of the housing 2 is increased by this.

The same remarks apply in respect to the cover end 133, a lateral wall 134 and a slope 135. The lateral walls 34, 134 are arranged and designed symmetrically to each other in respect to the switch axis 32. The lateral wall 134 is shorter than the lateral wall 34 only in the area farthest away in the upward direction 4 from the cover end 133. This asymmetry of the lateral walls 34, 134 is caused by the design of the base 16.

The base 16 is pushed into the interior of the housing 2 in the upward direction 4. The portions of the lateral walls 34, 134 facing away from the cover ends 33, 133 and extending starting at the slopes 35, 135 interlockingly surround the base 16. The interior walls of the slopes 35, 135 form end stops for the base 16 for its fixing in place within the housing 2.

A wedge tip of a flank extension 36 embodied in a wedge shape rests against the base 16 in the area of the slope 35. The flank extension 36 is a part of a flank 37 formed as one piece on the switching rocker 17 and extending in the longitudinal direction 7.

Adjoining the flank extension 36, the flank 37 is embodied as a segment of a hollow cylinder in the area of the bearing end 29 and acts as a trough 38. The trough 38 rests directly against the bearing end 29, embodied as a segment of a cylinder jacket, of the switch button 9. Because of this the forked arm 28 is guided by the trough 38 in the manner of a bearing block during the pivot movement of the switch button 9. The trough 38 is widened in the direction of the switch axis 32 in such a way that a portion of the surface of the forked arm 28, which adjoins the bearing end 29 and faces the switch axis 32, rests against the trough 38. This widening of the trough 38 constitutes a pivot stop for the forked arm 28. The flank 37 is angled in the direction of the switching rocker shaft 18 at the end of the trough 38 to form a flank web 39.

The flank 37 is constructed symmetrically in relation to a symmetry axis which is disposed vertically in respect to the connecting line of the hinge shafts 27, 127 and intersects the switching rocker 18. Therefore the switch button 109 is guided by a trough 138 in the same way as the switch button 9. The two flank webs 39, 139 are disposed at an obtuse angle in respect to each other. They meet in an area between the well 8 and the switching rocker shaft 18.

The lever arms, geometrically formed by the connecting line between the switching rocker shaft 18 and the hinge shaft 27 or 127 are structurally limited by covering faces 40, 140 facing the well 8. In FIG. 3, the covering faces 40, 140 form two sides, disposed at an obtuse angle in respect to each other, of the approximately trapezoidal-shaped switching rocker 17. In a center position between an on and off position of the switching rocker 17, the switch axis 32 extends through the vertex of the obtuse angle. In this center position the connecting line between the two hinge shafts 27, 127 is disposed perpendicularly to the switch axis 32.

In FIG. 3 the covering face 140 extends exactly in the longitudinal direction 7 and in the process rests against the inner end of the interior well compartment 110. The covering face 140 and the longitudinal axis 130 form a right angle in the process. In contrast thereto, the covering face 40 and the longitudinal axis 30 form an acute angle.

Because of the covering face 140 resting against the inner end of the interior well compartment 110, the actuation end 112 of the switch button 109 projects beyond the well 8 and is visible from the outside. The portion of the actuation end 112 visible from the outside indicates the switched-on state of the protective switch 1.

In FIG. 4 the protective switch 1 is shown with only one switch button 9. No switch button 109 is seated on the switching rocker shaft 127. The inner end of the interior well compartment 110 (FIG. 3) is covered by a well closure 15. The well closure 15, extending in the longitudinal direction 7, constitutes a one-piece connection between the well 8 and the cover end 133.

The protective switch 1 in FIG. 4 is in the switched-on state. The covering face 140 and the well closure 15 rest against each other with their surfaces facing each other.

The protective switch 1 of FIG. 4, equipped with only one switch button 9, can only be turned on manually (FIG. 4, FIG. 6).

In the area of the inner end of the interior well compartment 10, the well 8 has an end stop 31 disposed and embodied in the same way as the well 8 (in FIG. 3). In addition, a second end stop 31 is formed on the well 8, located opposite in the longitudinal direction 7 of the first end stop 31. It is disposed on the inner wall of the well 8 facing the well closure 15. They are placed symmetrically to each other in respect to the longitudinal axis 30.

The mode of operation of the protective switch 1 is explained by means of FIG. 3 to FIG. 6.

The switch button 109 extending beyond the well 8 toward the outside indicates the switched-on state of the protective switch in FIG. 3. The switching mechanism is triggered by the free end of the bimetal strip 23 bent in a counterclockwise direction. Because of this the switching rocker 17 is pivoted clockwise around its switching rocker shaft 18. In the course of this pivoting the switch buttons 9, 109 are displaced in the direction 4. During pivoting, the actuation end 112, which can be seen from the outside in the switched-on state of the protective switch 1, recedes into the interior well compartment 110. Simultaneously the actuation end 12 of the switch button 9 becomes visible from the outside (FIG. 5). By this the switch button 9 indicates the switched-off state of the protective switch 1. The electrical contact between the contact end 22 and the connecting terminal 113 is interrupted.

The pivotability of the switching rocker 17 is limited by its shape. To provide this, the flank extension 36 strikes against the inner end of the interior well compartment 10 in the area of the end stop 31 when the protective switch 1 is changed from its switched-on state (FIG. 3) to its switched-off state (FIG. 5). Simultaneously the flank extension 136 rests on the base 16 in the area of the slope 135. A defined switched-on position of the switching rocker 17 is achieved by means of this.

The above remarks apply equally to the change of the protective switch 1 indicated in FIG. 4 and FIG. 6 from its switched-on to its switched-off state. There, no switch button 109 is provided to indicate the switched-on state of the protective switch 1. The switched-on state of the protective switch 1 is indicated here by the switch button 9 not extending past the well 8 (FIG. 4). However, in FIG. 6 the switched-off state of the protective switch 1 is indicated, the same as in FIG. 4, by the switch button 9 projecting outward through the interior well compartment 10.

Departing from its switched-off state (FIG. 5, FIG. 6), the protective switch 1 can be switched on again by the manual actuation of the switch button 9. In the process the actuation end 12 of the switch button 9 is pushed into the interior well compartment 10. During the longitudinal displacement of the switch buttons 9, 109 in the direction 4, the actuation ends 12, 112 are tangent to the lateral walls of the well 8 or the separating web 11. Because of this the switch buttons 9, 109 can be operated in a simple manner like pushbuttons, wherein they are guidedly displaced in the direction of their longitudinal axis 30, 130.

The switch button 9 is pressure-actuated in the direction of the switching rocker 17 until its actuation end 12 rests against the end stop 31 (FIG. 3) or the two end stops 31 (FIG. 4). In the process the switching rocker 17 is pivoted counterclockwise. As soon as the actuation end 12 rests against the end stop 31, the flank extension 36 strikes the base 16 in the area of the slope 35. In addition, the covering face 140 rests against the inner end of the interior well compartment 110 (FIG. 3) or the well closure 15 (FIG. 4). The longitudinal displacement of the switch button 9 and the pivoting of the switching rocker 17 are limited by this, so that a definite switched-on position of the switching rocker 17 is achieved. Furthermore, because of the many limit stops, damage to or destruction of the switch button 9, 109, the switching rocker 17 or other components of the switching mechanism because of excessive force stresses are prevented.

Only the protective switch 1 with the two switch buttons 9, 109 can be manually switched off again (FIG. 3). To achieve this, the actuation end 112 of the switch button 109 is pushed into the interior well compartment 110. The longitudinal displacement of the switch button 109 is limited by the end stop 131. At the same time the pivoting of the switching rocker 17 in the clockwise direction is limited by the flank extensions 36, 136 striking the well 8 or the base 16 (FIG. 5). As soon as the switch button 109 rests against the end stop 131 with its actuation end 112 following manual operation, the former is no longer visible viewed in the transverse direction 5. Instead, the actuation end 12 of the switch button 9 projects outward past the well 8 and indicates the switched-off state of the protective switch 1.

The visible recognition of the switching state of the protective switch 1 can additionally be improved by designing the surface of the switch buttons 9, 109 in different colors or providing them with a particular warning color.

Because of the particular shape of the switching rocker 17, in a center position of the switching rocker 17 located between the switched-on and switched-off position, the geometric lever arms are disposed parallel to the housing cover 3 and perpendicularly to the longitudinal axes 30, 130. Starting from this center position, the same displacement path in the upward direction 4 results for the switch buttons 9, 109 to reach the switched-on or switched-off position of the switching rocker 17. This favors the symmetrical and therefore space-saving design of the protective switch 1. This special arrangement of the geometric lever arms is also very useful for being able to approximate the displacement of the hinge shafts 27, 127, which really follow a circular path in the movement plane of the switching rocker 17, as exactly as possible to a longitudinal displacement in the upward direction 4. This is a prerequisite for a simple mode of functioning of the switch buttons 9, 109 and the narrow design of the protective switch 1.

The guidance of the switch buttons 9, 109 during their longitudinal displacement is further improved by the troughs 38, 138 resting against the bearing ends 29. They furthermore limit the pivotability of the switch buttons 9, 109 in the movement plane of the switching rocker 17.

Figure 7:
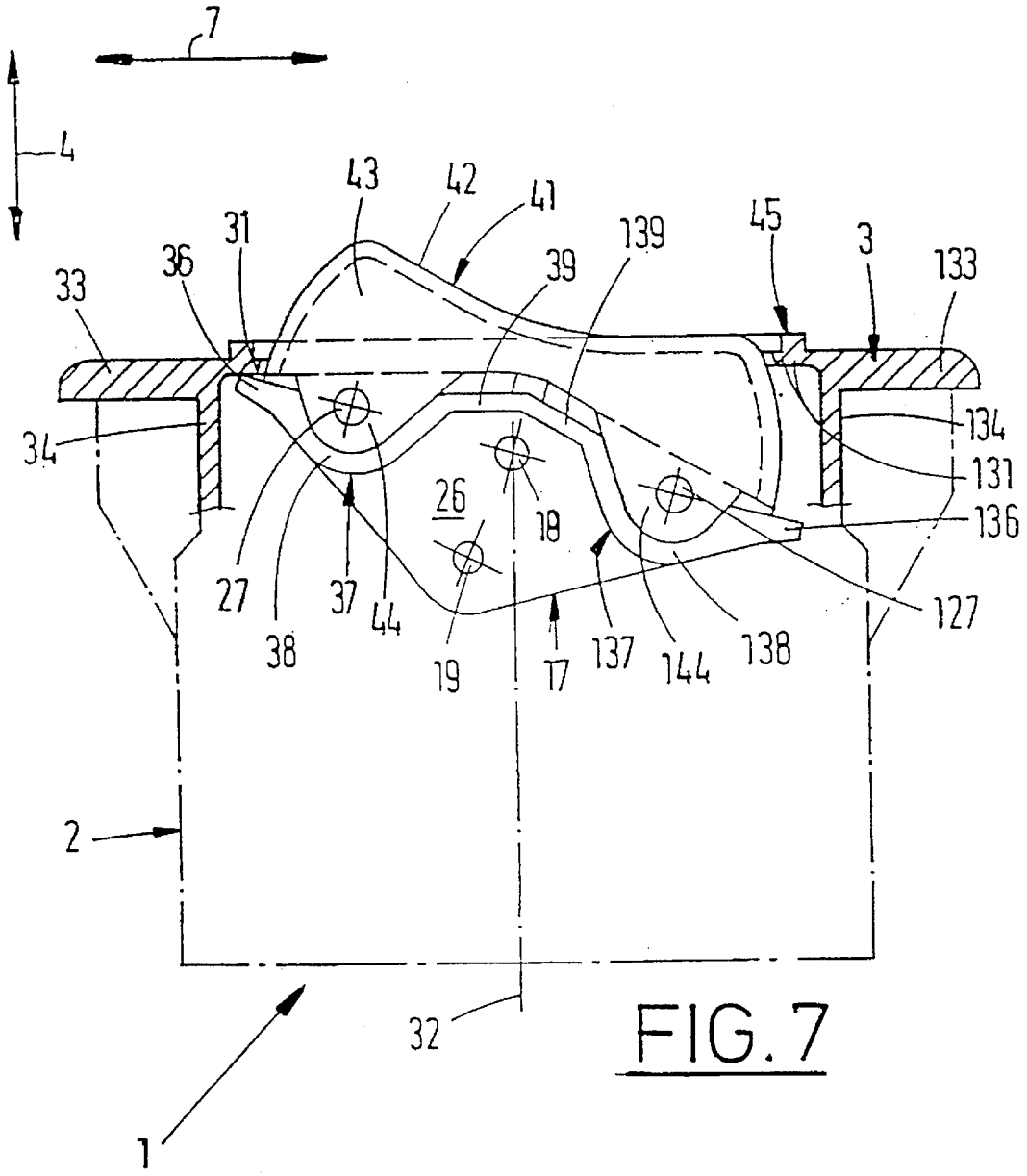

In FIG. 7 it can be seen that a switch cap 41 has been placed on the switching rocker 17 and fixed in place on it. The housing 2 of the protective switch has only been schematically represented by dash-dotted lines. The switching rocker 17 keeping the switch cap 41 in place is identical to the switching rocker 17 keeping the switch buttons 9, 109 in place. The cover 3 with its cover ends 33, 133 and the lateral walls 34, 134 adjoining it toward the remainder of the housing 2 are also structurally identical to the exemplary embodiments in FIGS. 1 to FIG. 6. Essentially the housing cover 3 in FIG. 7 differs from the other exemplary embodiments only by the design of a well for receiving the switch cap 41. The well surrounds the switch cap 41 as a cap well 45 in the plane extended in the transverse direction 5 and the longitudinal direction 7 at a short distance for the free movement of the switch cap 41 in accordance with the switching movements of the switching rocker 17. The cap well 45 only slightly projects past the surface of the cover 3 in the upward direction 4 in contrast to the well 8. In this case the upper surface of the cap well 45 terminates flush with the partial area of the upper cap surface 42 which extends parallel with the longitudinal direction 7 depending on the switch position of the switching rocker 17. Both partial areas are separated from each other by the trough-shaped depression of the upper cap surface 42 which extends convexly in respect to the switching rocker 17, and are functionally comparable with the actuation ends 12, 112 of the switch buttons 9, 109.

The switch cap 41 is symmetrical in relation to the switch axis 32 as long as the connecting line between the hinge shafts 27 and the switching rocker shaft 18 extends parallel to the longitudinal direction 7. The upper cap surface 42 is connected with two congruent forked cap arms 43, of which only one forked cap arm 43 is visible in FIG. 7. The forked cap arms 43 are enclosed in a plane formed by the upward direction 4 and the longitudinal direction 7. They project past the switching rocker 17 and rest with their facing surfaces on respectively one exterior side of the switching rocker 17. The edge of the forked cap arm 43 facing the troughs 38, 138 and the flank webs 39, 139 and aligned in the longitudinal direction is widened in a V-shape. The two V-legs are disposed at an obtuse angle in relation to each other and extend parallel with the flank webs 39, 139. The two V-legs are widened by respectively one cap bearing end 44, 144. The two cap bearing ends 44, 144 face the flanks 37, 137 approximately in the upward direction 4 and rest interlockingly against the troughs 38, 138. The cap bearing ends 44, 144 respectively contain a bore through which the hinge shaft 27 or 127 extends. The switch cap 41 is immovably fixed on the switching rocker by means of the hinge shafts 27, 127.

The description of FIG. 1 to FIG. 6 applies analogously in regard to the mode of functioning of the switching rocker 17. For example, similar to the aforementioned embodiment, the well 45 defines a height, and switch cap 41 has a structural height matched to the height of well 45. As such, in only one of the two switched positions, the actuation end of the switch cap will extend past the opening of the receiving well.

The construction of the protective switch 1 described here is suitable for one-pole and multi-pole protective switches, which can also be provided with further added devices or protective elements.

We claim:

1. A protective switch having an actuation side, comprising:

a base having walls;

a pivot shaft connected to the walls of said base;

a switching rocker pivotal on said pivot shaft to be pivotally seated on said base, and including two lever arms for switching the protective switch on and off;

a housing placed on said base and protectively surrounding said switching rocker;

a selected housing cover chosen from a kit comprising at least two differently configured housing covers, said selected housing cover being located on the actuation side of the protective switch and protectively covering the switching rocker, said selected housing cover including an opening therethrough;

a plurality of hinges each disposed on a respective lever arm of said switching rocker;

a selected actuation attachment extending through the opening of said selected housing cover and being modularly connected to said switching rocker by said hinges for pivoting said switching rocker, and selected from a kit comprising at least one switch button longitudinally displaceable in said selected housing cover and pivotally connected with one of said lever arms, and a switch cap rotatably movable relative to said pivot shaft and rigidly connected with the two lever arms of said switching rocker, said at least one switch button and said switch cap being interchangeable, said selected housing cover and said selected actuation attachment being matched together.

2. A protective switch as defined in claim 1, wherein said hinge comprises an axial hinge having a hinge shaft extending parallel with the pivot shaft.

3. A protective switch as defined in claim 1, wherein said actuation attachment includes a bearing end modularly connected to a respective lever arm by said hinge.

4. A protective switch as defined in claim 3, wherein said switching rocker is pivotal in a plane of movement, said actuation attachment being movable within the plane of movement of the switching rocker.

5. A protective switch as defined in claim 1, wherein the selected actuation attachment comprises a single switch button connected with a respective one lever arm of said switching rocker, the other lever arm being covered over by said housing cover.

6. A protective switch as defined in claim 1, wherein the protective switch has first and second switch conditions corresponding to a positioning of the respective lever arms, the actuation attachment extending further from the opening over one of the lever arms in the first switch condition than in the second switch condition to indicate a switched state of the protective switch.

7. A protective switch as defined in claim 1, further comprising a receiving well attached to and projecting beyond said housing cover, said receiving well including an edge defining the opening of said housing cover.

8. A protective switch as defined in claim 7, wherein the protective switch has first and second switch positions, and wherein said receiving well defines a height, and the selected at least one switch button has an actuation end defining a length, the height of said receiving well and the length of said switch button being matched so that in only one of the two switched positions the actuation end of said switch button extends past an opening of said receiving well.

9. A protective switch as defined in claim 7, wherein the protective switch has first and second switch positions, and wherein said receiving well defines a height, and the selected switch cap has an actuation end comprising an upper cap surface defining a structural height, the height of said receiving well and the structural height of said switch cap being selected so that in only one of the two switched positions the actuation end of said switch cap extends past an opening of said receiving well.

10. A protective switch as defined in claim 7, wherein said receiving well includes a protrusion projecting into an interior area of an inner end of said receiving well to form an end stop for an actuation end of said actuation attachment.

11. A protective switch as defined in claim 1, wherein said switching rocker is pivotal to define a switched-on and a switched-off position with a center position located therebetween, said hinge and said pivot shaft defining a line which is approximately parallel with said housing cover when said switching rocker is in the center position.

12. A protective switch as defined in claim 1, wherein the protective switch has first and second switch positions, a respective one lever arm touching an inside of said housing cover in both respective switch positions to form a pivot limit stop.

13. A protective switch as defined in claim 1, wherein the protective switch has first and second switch positions, and each lever arm has a respective covering face facing said housing cover, said covering faces forming an obtuse angle relative to one another, an essentially entire surface of a respective covering face resting against an inner surface of said housing cover in the respective first and second positions.

14. A protective switch as defined in claim 1, wherein said switching rocker is pivotal in a plane of movement, and wherein said actuation attachment includes a plurality of forked arms each having a bearing end and each located on a respective different side of the plane of movement for gripping a respective lever arm.

15. A protective switch as defined in claim 14, wherein said switching rocker has two flanks each extending parallel to the plane of movement, said forked arms each being seated flatly against a respective flank.

16. A protective switch as defined in claim 14, wherein said switching rocker has two flanks each having at least one hollowed-out flank protrusion forming a bearing block, the bearing ends of said forked arms being composed as cylinder jacket segments guided on said hollowed-out flank protrusions, said hinge forming a cylinder axis of the cylinder jacket segments.

17. A protective switch as defined in claim 16, wherein the protective switch has first and second switch positions, and said hollowed-out flank protrusions each form a trough tapered away from said actuation attachment, said trough forming a lateral pivot stop in both switch positions for said forked arms of the selected at least one switch button.

18. A protective switch as defined in claim 1, wherein said switching rocker is symmetrical relative to an axis of symmetry located perpendicular to and bisecting a connecting line defined between respective hinges on said two lever arms.

19. A protective switch as defined in claim 1, wherein each lever arm has a respective covering face facing said housing cover, and the selected switch cap has an actuation end comprising an upper cap surface covering the covering faces of said two lever arms.

20. A protective switch as defined in claim 19, wherein said switching rocker has two flanks each having two troughs, and the selected switch cap has two forked cap arms each having two cap bearing ends each resting against a respective one of the troughs of said flanks.

21. A protective switch as defined in claim 20, wherein said cap bearing ends each rests interlockingly against the troughs of said flanks.

22. A protective switch as defined in claim 1, wherein the selected actuation attachment comprises two switch buttons each connected with a respective one lever arm of said switching rocker.

* * * * *

UNITED STATES PATENT AND TRADEMARK OFFICE

CERTIFICATE OF CORRECTION

PATENT NO. : 5,558,211
DATED : September 24, 1996
INVENTOR(S) : Konrad Heydner , et al.

It is certified that error appears in the above-identified patent and that said Letters Patent is hereby corrected as shown below:

On the title page, after item [21], item [22] should read-- September 17, 1993--.
Insert the following:

[86] PCT No. PCT/DE93/00880

§371 Date: Mar. 15, 1995

§102(e) Date: Mar. 15, 1995

[87] PCT Pub. No.: WO94/07255

PCT Pub. Date: Mar. 31, 1994

Signed and Sealed this

Eleventh Day of March, 1997

*Attest:*

*Attesting Officer*

Bruce Lehman

BRUCE LEHMAN

*Commissioner of Patents and Trademarks*